US006736451B1

(12) United States Patent
Chen

(10) Patent No.: US 6,736,451 B1
(45) Date of Patent: May 18, 2004

(54) FOLDABLE FRAME WITH POSITIONS LOCKING DEVICE FOR USE IN A HOOK-ON TYPE BABY SEAT

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 10/424,719

(22) Filed: Apr. 29, 2003

(51) Int. Cl.[7] ..... A47B 39/00

(52) U.S. Cl. ..... 297/174 CS; 297/251; 297/373

(58) Field of Search ..... 297/174 CS, 256.1, 297/251, 354.1, 354.12, 361.1, 374, 153, 373

(56) References Cited

U.S. PATENT DOCUMENTS 3,328,079 A * 6/1967 Byczkowski et al. ..... 297/373
4,568,120 A * 2/1986 Hoffman ..... 297/174 CS
4,938,400 A * 7/1990 Springston ..... 297/174 CS
5,470,127 A * 11/1995 Kassai et al. ..... 297/174 CS
6,014,806 A * 1/2000 Ohya ..... 29/893.33
6,023,994 A * 2/2000 Yoshida ..... 74/530
6,273,503 B1 * 8/2001 Cheng ..... 297/174 CS
6,527,342 B2 * 3/2003 Glaspie et al. ..... 297/373

* cited by examiner

*Primary Examiner*—Peter M. Cuomo
*Assistant Examiner*—Stephanie Harris
(74) *Attorney, Agent, or Firm*—Baker Botts L.L.P.

(57) ABSTRACT

The foldable frame of a baby seat includes a seat member, a backrest member, and a position locking device. The position locking device includes a first positioning member mounted on the seat member and formed with a first receiving space, a second positioning member mounted on the backrest member, coupled pivotally to the first positioning member, and formed with a second receiving space, and a stop member that is movable from a locking position, where the stop member extends simultaneously into the first and second receiving spaces and prevents pivoting movement of the backrest member relative to the seat member, to an unlocking position, where the stop member is disposed in only one of the first and second receiving spaces and permits pivoting movement of the backrest member relative to the seat member.

15 Claims, 6 Drawing Sheets

FOLDABLE FRAME WITH POSITIONS LOCKING DEVICE FOR USE IN A HOOK-ON TYPE BABY SEAT

BACKGROUND OF THE INVENTION

1. Field of the Invention

The invention relates to a foldable frame with a position locking device, more particularly to a foldable frame with a position locking device for use in a hook-on type baby seat.

2. Description of the Related Art

In U.S. Pat. No. 4,568,120, there is disclosed a hook-on type baby seat that includes a seat portion and a back portion coupled to a forwardly projecting anchor member. The anchor member is adapted to overlie a tabletop. The baby seat further includes grip means having a pair of free ends below the anchor member for gripping a bottom surface of the tabletop. The grip means is movably coupled to the anchor member and the seat portion such that the free ends of the grip means are supported for movement toward and away from the elevation of the anchor member. Latch means extends between the grip means and the back portion of the baby seat for latching the free ends of the grip means in one of a plurality of positions.

A bracket interconnects the seat and back portions. The baby seat further includes a spring-loaded pin provided on the back portion and extending though the bracket so as to hold the back portion in an operative position relative to the seat portion. A plastic button release is mounted on the bracket and is in contact with the pin. By pushing the button release, the pin is moved inwardly to disengage the bracket so as to permit folding of the back portion on the seat portion.

The following are some of the drawbacks of the aforesaid baby seat: Accidents can easily occur due to relative pivoting movement among the bracket, the seat portion and the back portion when folding and unfolding the back portion. Moreover, the button release is usually made of non-durable plastic material, and is likely to break after long-term use.

SUMMARY OF THE INVENTION

Therefore, the main object of the present invention is to provide a foldable frame with a position locking device that can overcome the aforesaid drawbacks associated with prior art.

Another object of the present invention is to provide a hook-on type baby seat with a foldable frame that includes a position locking device.

According to one aspect of the present invention, a foldable frame comprises a first frame member, a second frame member, and a position locking device pivotally interconnecting the first and second frame members such that the second frame member is pivotable relative to the first frame member between folded and unfolded positions. The position locking device includes:

- a first positioning member mounted on the first frame member and having one side formed with a first receiving space, the first receiving space having a non-circular cross-section;
- a second positioning member mounted on the second frame member and having one side that confronts said one side of the first positioning member and that is formed with a second receiving space, the second receiving space having the non-circular cross-section, the second positioning member being pivotally connected to the first positioning member; and

- a stop member slidably disposed in the first and second positioning members and having the non-circular cross-section, the stop member being movable from a locking position, where the stop member extends simultaneously into the first and second receiving spaces and prevents pivoting movement of the second frame member relative to the first frame member, to an unlocking position, where the stop member is disposed in only one of the first and second receiving spaces and permits pivoting movement of the second frame member relative to the first frame member.

According to another aspect of the present invention, a baby seat comprises:

- a seat member with a rear end;
- a backrest member with a lower end;
- a position locking device pivotally interconnecting the seat and backrest members such that the backrest member is pivotable relative to the seat member between folded and unfolded positions, the position locking device including
- a first positioning member mounted on one of the rear end of the seat member and the lower end of the backrest member and having one side formed with a first receiving space, the first receiving space having a non-circular cross-section,
- a second positioning member mounted on the other one of the rear end of the seat member and the lower end of the backrest member and having one side that confronts said one side of the first positioning member and that is formed with a second receiving space, the second receiving space having the non-circular cross-section, the second positioning member being pivotally connected to the first positioning member, and
- a stop member slidably disposed in the first and second positioning members and having the non-circular cross-section, the stop member being movable from a locking position, where the stop member extends simultaneously into the first and second receiving spaces and prevents pivoting movement of the backrest member relative to the seat member, to an unlocking position, where the stop member is disposed in only one of the first and second receiving spaces and permits pivoting movement of the backrest member relative to the seat member;
- a forwardly projecting anchor member coupled to the seat and backrest members and adapted to overlie a tabletop; and
- a grip member coupled to the anchor member and having a pair of free ends disposed below the anchor member and adapted for gripping a bottom surface of the tabletop.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
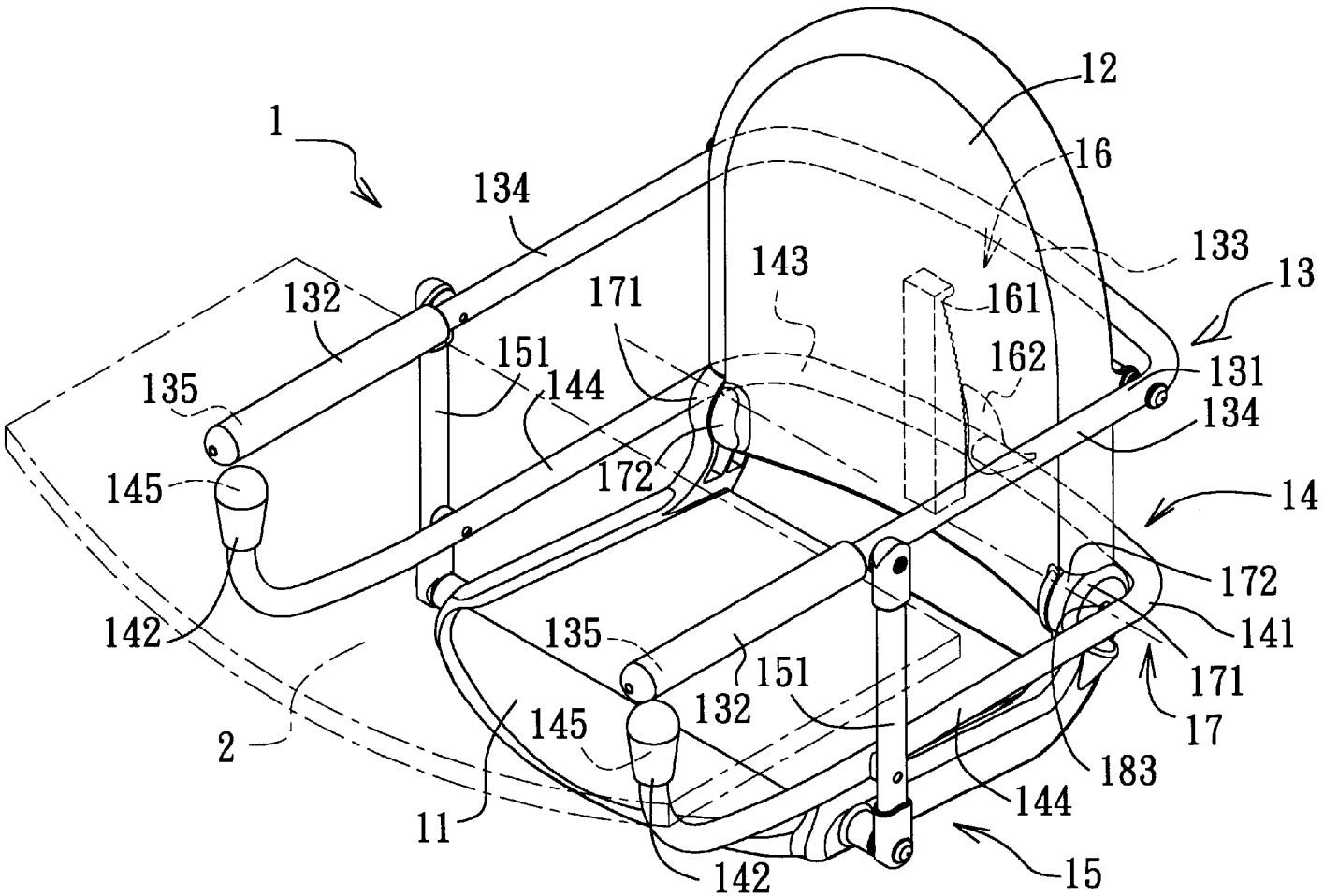
FIG. 1 is a perspective view showing the preferred embodiment of a baby seat according to the present invention.
Figure 2:
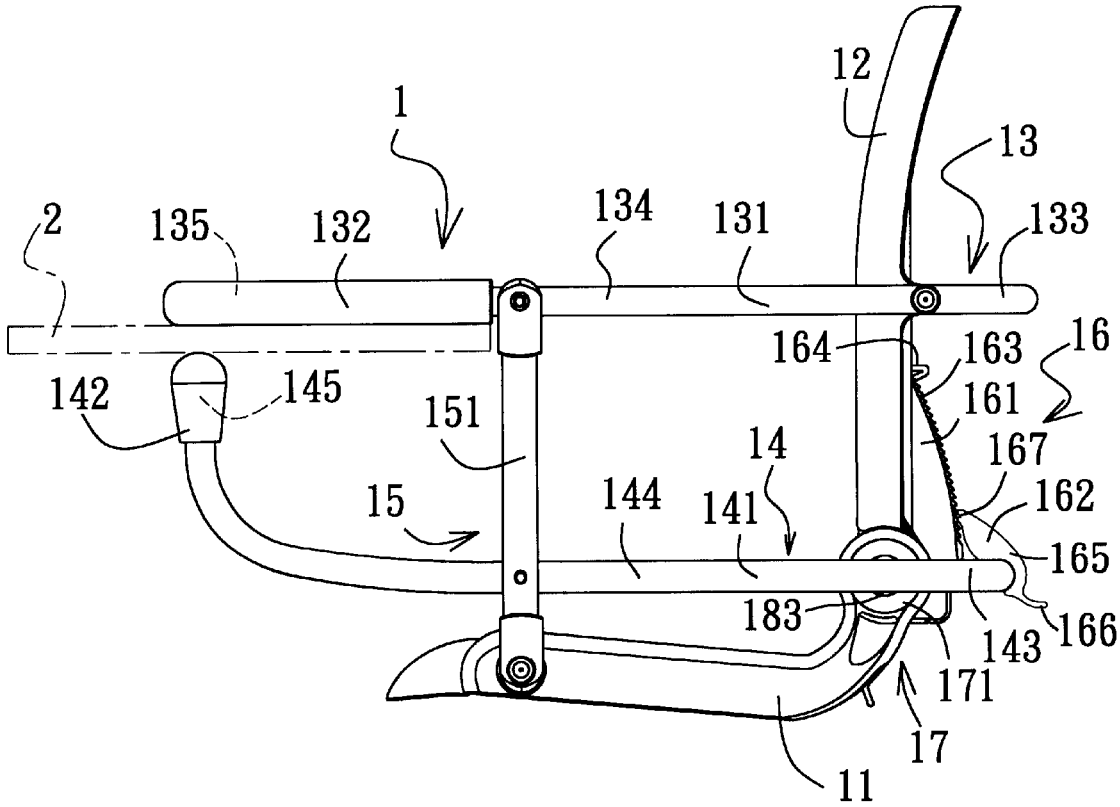
FIG. 2 is a schematic side view of the preferred embodiment.

Referring to FIGS. 1 and 2, the preferred embodiment of a baby seat 1 according to the present invention is shown to be adapted to be attached to a tabletop 2. The baby seat 1 includes a seat member 11, a backrest member 12, a forwardly projecting anchor member 13, a grip member 14, a connecting member 15, a latch member 16, and a pair of position locking devices 17.

The position locking devices 17, which will be described in greater detail in the succeeding paragraphs, pivotally interconnect the seat and backrest members 11, 12 such that the backrest member 12 is pivotable relative to the seat member 11 between folded and unfolded positions.

The anchor member 13 is adapted to overlie the tabletop 2, and includes a first U-shaped frame 131 having a pair of parallel first portions 134 connected pivotally and respectively to opposite lateral sides of the backrest member 12, and a first connecting portion 133 interconnecting the first portions 134 and disposed behind the backrest member 12. Each first portion 134 has a free end 135 with a grip sleeve 132 sleeved thereon for contacting the tabletop 2 when the first portion 134 overlies the latter.

The connecting member 15 includes a pair of links 151, each of which has a first end connected pivotally to a respective one of the first portions 134, and a second end connected pivotally to a respective lateral side of the seat member 11.

The grip member 14 includes a second U-shaped frame 141 having a pair of parallel second portions 144 respectively disposed adjacent to the lateral sides of the backrest member 12, and a second connecting portion 143 interconnecting the second portions 144 and disposed behind the backrest member 12. Each second portion 144 is connected pivotally to a respective link 151, and has a free end 145 with a grip sleeve 142 sleeved thereon. The free ends 145 of the second portions 144 are disposed below the free ends 135 of the first portions 134 of the anchor member 13. The links 151 of the connecting member 15 couple the grip member 14 to the anchor member 13 and the seat member 11 such that the free ends 145 of the second portions 144 are supported for movement toward and away from the free ends 135 of the first portions 134 of the anchor member 13. The grip sleeves 142 grip the bottom surface of the tabletop 2 when the second portions 144 are extended under the tabletop 2. Accordingly, the anchor member 13 and the grip member 14 cooperate to anchor the baby seat 1 at an edge of the tabletop 2. Moreover, since the grip sleeves 132, 142 are the only portions that engage the tabletop 2, the tabletop 2 will not be marred when the baby seat 1 is anchored thereon.

The latch member 16 extends between the grip member 14 and the backrest member 12 for latching the free ends 145 of the grip member 14 in one of a plurality of positions when the backrest member 12 is disposed at the unfolded position. The latch member 16 includes a rack 161 attached to the backrest member 12, and a spring-loaded pawl 162 pivotally attached to the second connecting portion 143 for movement therewith. The rack 161 has teeth 163 formed on a curved surface thereof, and a stop block 164 formed on a top end thereof. The pawl 162 includes a pawl body 165 pivotally connected to the second connecting portion 143, a pair of teeth 167 on a top end thereof for meshing with the teeth 163 on the rack 161, and a handle 166 on a bottom end thereof to permit manipulation of the pawl 162. The pawl 162 is biased by a torsion spring (not shown) to maintain engagement between the teeth 167 on the pawl 162 and the teeth 163 on the rack 161. The stop block 164 prevents the pawl 162 from disengaging from the rack 161 upon reaching the top end of the rack 161. By operating the handle 166, the grip member 14 can be moved so as to engage or disengage from the bottom surface of the tabletop 2.

Figure 3:
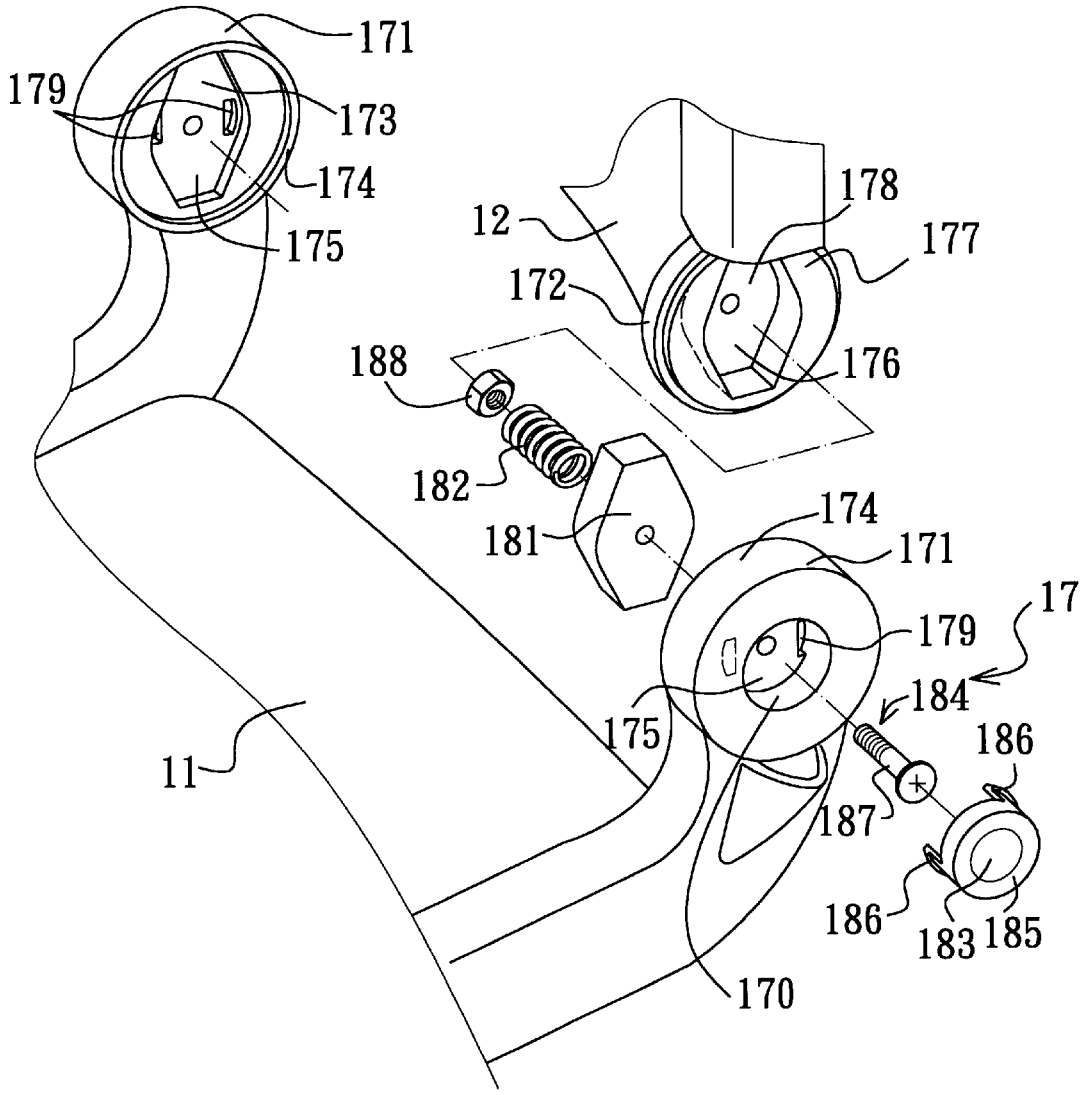
FIG. 3 is an exploded perspective view to illustrate a position locking device of the preferred embodiment.
Figure 4:
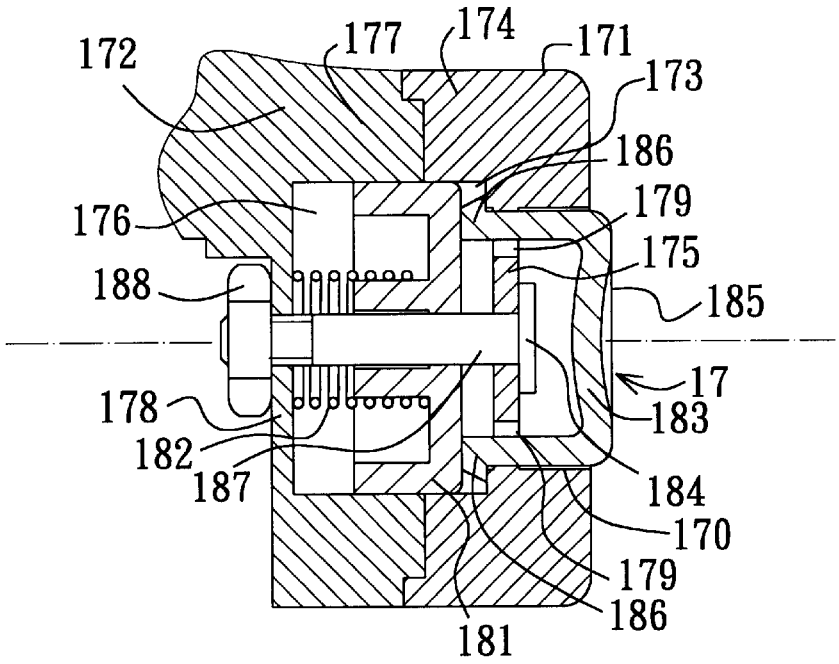
FIG. 4 is a schematic cross-sectional view of the position locking device to illustrate a stop member when at a locking position.
Figure 5:
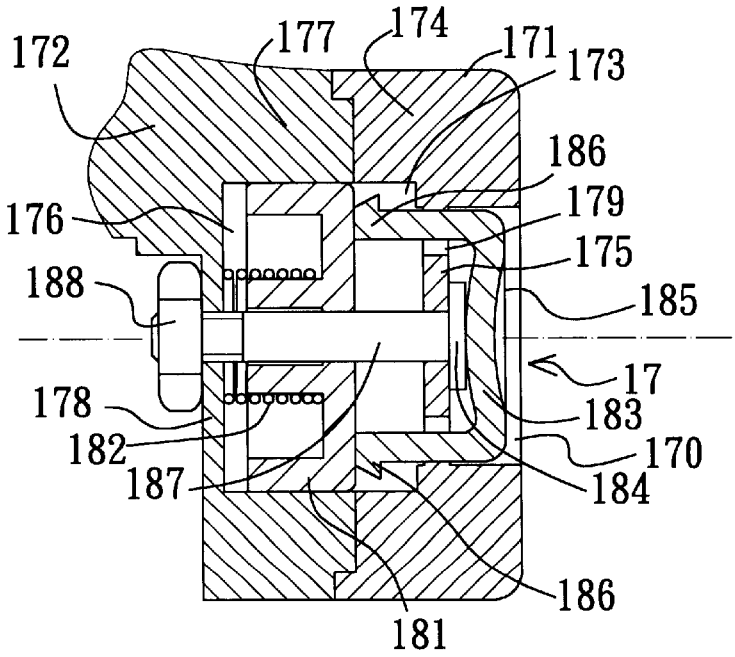
FIG. 5 is a schematic cross-sectional view of the position locking device to illustrate the stop member when at an unlocking position.

Referring to FIGS. 3, 4, and 5, each of the position locking devices 17 includes a first positioning member 171, a second positioning member 172, and a stop member 181. The first positioning members 171 of the position locking devices 17 are mounted on the rear end of the seat member 11. On the other hand, the second positioning members 172 of the position locking devices 17 are mounted on the lower end of the backrest member 12.

In this embodiment, each first positioning member 171 includes a first locking cap 174 integrally formed with the seat member 11. The first locking cap 174 has one side formed with a first receiving space 173, and an opposite side formed with a button hole 170. The first receiving space 173 and the button hole 170 are separated by a partition wall 175. The partition wall 175 is formed with a pair of slots 179 therethrough. The first receiving space 173 has a non-circular cross-section, which is oval in this embodiment.

In this embodiment, each second positioning member 172 includes a second locking cap 177 integrally formed with the backrest member 12. The second locking cap 177 has a first side that confronts the adjacent first positioning member 171 and that is formed with a second receiving space 176, and an opposite second side formed with an end wall 178. The second receiving space 176 has the same non-circular cross-section as the first receiving space 174.

It is noted that, although the first and second positioning members 171, 172 are integrally formed with the respective one of the seat and backrest members 11, 12 in this embodiment, in practice, it is feasible to form the first and second positioning member 171, 172 separate from the seat and backrest members 11, 12. Under such a situation, the first and second positioning members 171, 172 can be secured to the seat and backrest members 11, 12 in any suitable manner when assembling the baby seat 1.

Each stop member 181 is slidably disposed in the first and second positioning members 171, 172 and has the aforesaid non-circular cross-section. The stop member 181 is movable from a locking position, where the stop member 181 extends simultaneously into the first and second receiving spaces 173, 176 and prevents pivoting movement of the backrest member 12 relative to the seat member 11, as best shown in FIG. 4, to an unlocking position, where the stop member 181 is disposed in only one of the first and second receiving spaces 173, 176 and permits pivoting movement of the backrest member 12 relative to the seat member 11, as best shown in FIG. 5. In the preferred embodiment, the backrest member 12 is at the unfolded position shown in FIGS. 1 and 2 when the stop member 182 is at the locking position. Each position locking device 17 further includes a biasing member 182, a button member 183, and a pivot axle 184.

The biasing member 182 of each position locking device 17 is in the form of a coiled compression spring in this embodiment, is disposed in the respective second receiving space 176, and has one end abutting against the stop member 181 and the other end abutting against the end wall 178 of the second locking cap 177 for biasing the stop member 181 to the locking position.

The button member 183 of each position locking device 17 includes a pressing portion 185 and a pair of hooks 186 extending from the pressing portion 185. The pressing portion 185 is movably received in the button hole 170 of the respective first locking cap 174, and the hooks 186 extend through the slots 179 in the partition wall 175 of the respective first locking cap 174 and abut against the respective stop member 181. The button member 183 is operable so as to force the stop member 181 to the unlocking position against biasing action of the biasing member 182.

The pivot axle 184 of each position locking device 17 includes a bolt 187 and nut 188. The bolt 187 passes through the partition wall 175 of the respective first locking cap 174, the respective stop member 181, the respective biasing member 182 and the end wall 178 of the respective second locking cap 177 for threaded engagement with the nut 188, thereby pivotally interconnecting the first and second positioning members 171, 172.

It should be noted that the pivot axles 184 are not necessarily mounted between the first and second positioning members 171, 172. The pivot axles 184 can be mounted at any position as long as the seat and backrest members 11, 12 are pivotally connected and as long as the first and second positioning members 171, 172 are pivotable relative to each other.

Figure 6:
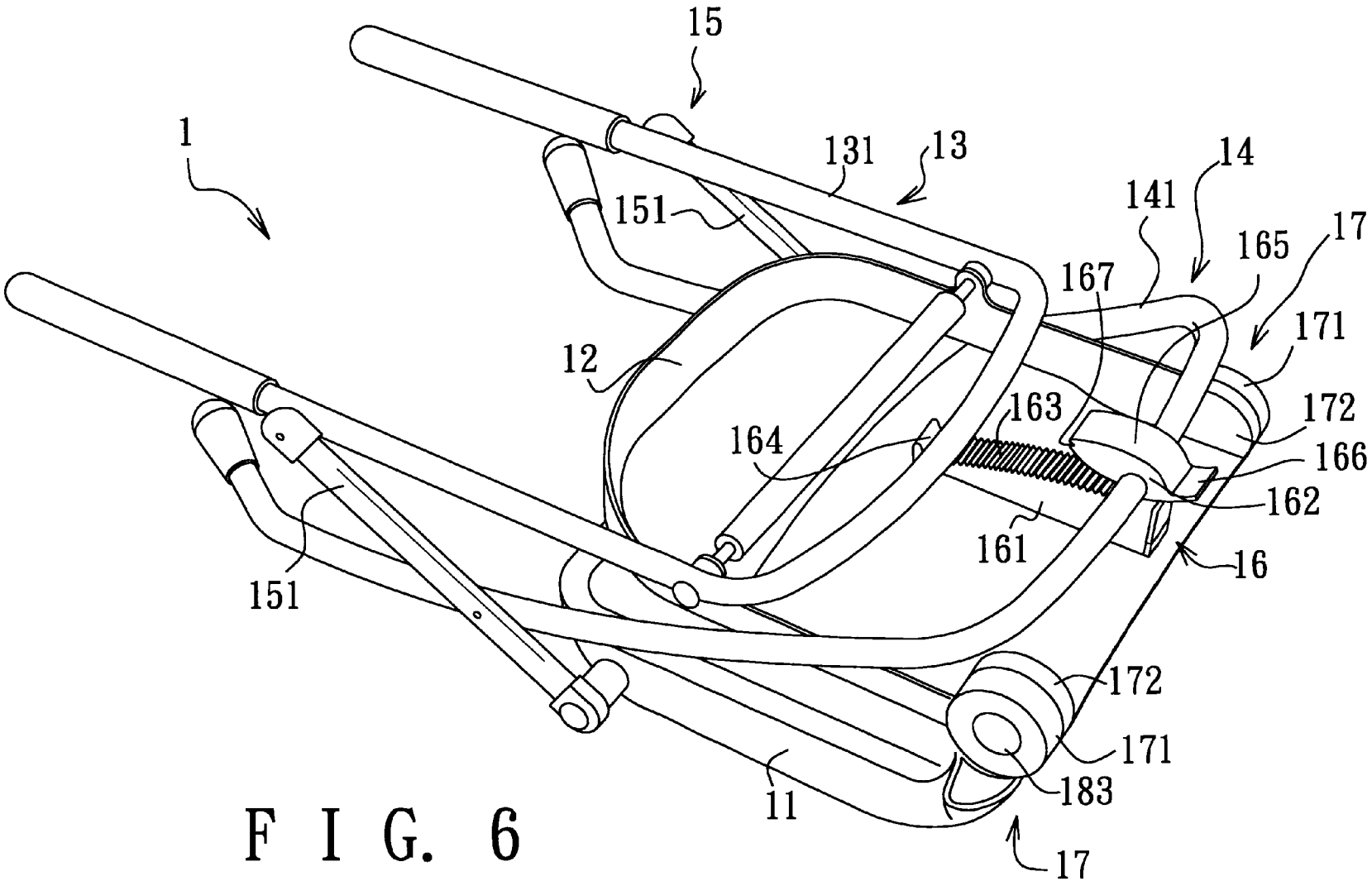
FIG. 6 is a perspective view illustrating the preferred embodiment when in a folded state.

In practice, when the backrest member 12 is locked by the biasing members 182 so as to extend simultaneously into the first and second receiving spaces 173, 176, thereby preventing pivoting movement of the backrest member 12 relative to the seat member 11. At the same time, the stop members 181 push the hooks 186 of the button members 183 to engage the partition walls 175 and to cause the button members 183 to protrude from the button holes 170. Thereafter, when it is desired to fold the backrest member 12 for storing the baby seat 1, the pressing portions 185 of the button members 183 are simultaneously pushed inwardly, thereby moving the stop members 181 entirely into the second receiving spaces 176 so that the backrest member 12 can be pivoted relative to the seat member 11. The backrest member 12 is then pushed forwardly for folding on the seat member 11, as best shown in FIG. 6.

Figure 7:
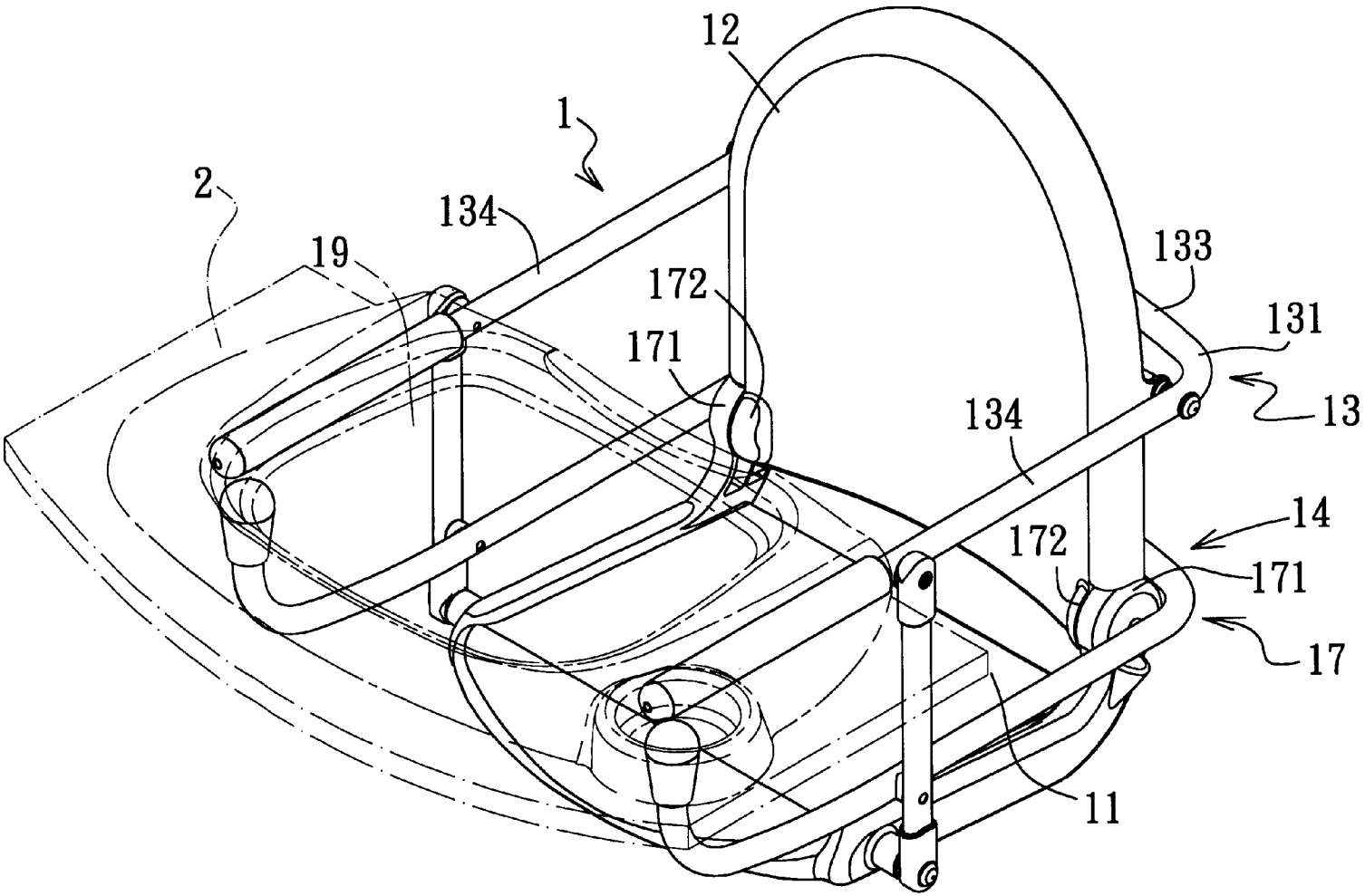
FIG. 7 is another perspective view of the preferred embodiment to illustrate a tray removably disposed on an anchor member.

Referring to FIG. 7, the baby seat 1 of the present invention can further include a tray 19 removably disposed on the first portions 134 of the anchor member 13 when the baby seat 1 is mounted on the tabletop 2.

The seat member 11, the backrest member 12 and the position locking devices 17 constitute a foldable frame of the baby seat 1. The foldable frame as such should not be limited to the baby seat 1 and can be modified for use in other types of seats, such as a lawn chair.

As compared to the conventional baby seat with the exposed bracket, the baby seat 1 of the present invention is safer to use since the position locking devices 17 use stop members 181 that are entirely encapsulated within first and second positioning members 171, 172. Moreover, the use of the button members 183 and the biasing members 182 in the position locking devices 17 results in a more durable construction as compared to the plastic button release in the conventional baby seat described hereinabove.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable frame comprising first and second frame members, and a position locking device pivotally interconnecting said first and second frame members such that said second frame member is pivotable relative to said first frame member between folded and unfolded positions, said position locking device including a first positioning member mounted on said first frame member and having one side formed with a first receiving space, said first receiving space having a non-circular cross-section, a second positioning member mounted on said second frame member and having one side that confronts said one side of said first positioning member and that is formed with a second receiving space, said second receiving space having the non-circular cross-section, said second positioning member being pivotally connected to said first positioning member, and a stop member slidably disposed in said first and second positioning members and having the non-circular cross-section, said stop member being movable from a locking position, where said member extends stop simultaneously into said first and second receiving spaces and prevents pivoting movement of said second frame member relative to said first frame member, to an unlocking position, where said stop member is disposed in only one of said first and second receiving spaces and permits pivoting movement of said second frame member relative to said first frame member;

wherein said position locking device further includes a biasing member for biasing said stop member to the locking position, and wherein said position locking device further includes a button member mounted movably on one of said first and second positioning members and extending into one of said first and second receiving spaces to abut against said stop member, said button member being operable so as to force said stop member to the unlocking position against biasing action of said biasing member.

2. The foldable frame as claimed in claim 1, wherein said second frame member is at the unfolded position when said stop member is at the locking position.

3. A foldable frame comprising first and second frame members, and a position locking device pivotally interconnecting said first and second frame members such that said second frame member is pivotable relative to said first frame member between folded and unfolded positions, said position locking device including a first positioning member mounted on said first frame member and having one side formed with a first receiving space, said first receiving space having a non-circular cross-section, a second positioning member mounted on said second frame member and having one side that confronts said one side of said first positioning member and that is formed with a second receiving space, said second receiving space having the non-circular cross-section, said second positioning member being pivotally connected to said first positioning member, and a stop member slidably disposed in said first and second positioning members and having the non-circular cross-section, said stop member being movable from a locking position, where said member extends stop simultaneously into said first and second receiving spaces and prevents pivoting movement of said second frame member relative to said first frame member, to an unlocking position, where said stop member is disposed in only one of said first and second receiving spaces and permits pivoting movement of said second frame member relative to said first frame member;

wherein said position locking device further includes a biasing member for biasing said stop member to the locking position, wherein said position locking device further includes a pivot axle pivotally interconnecting said first and second positioning members, and wherein said biasing member is a coiled compression spring sleeved on said pivot axle, said pivot axle extending slidably through said stop member.

4. A baby seat comprising:

a seat member with a rear end;

a backrest member with a lower end;

a position locking device pivotally interconnecting said seat and backrest members such that said backrest member is pivotable relative to said seat member between folded and unfolded positions, said position locking device including a first positioning member mounted on one of said rear end of said seat member and said lower end of said backrest member and having one side formed with a first receiving space, said first receiving space having a non-circular cross-section, a second positioning member mounted on the other one of said rear end of said seat member and said lower end of said backrest member and having one side that confronts said one side of said first positioning member and that is formed with a second receiving space, said second receiving space having the non-circular cross-section, said second positioning member being pivotally connected to said first positioning member, and a stop member slidably disposed in said first and second positioning members and having the non-circular cross-section, said stop member being movable from a locking position, where said stop member extends simultaneously into said first and second receiving spaces and prevents pivoting movement of said backrest member relative to said seat member, to an unlocking position, where said stop member is disposed in only one of said first and second receiving spaces and permits pivoting movement of said backrest member relative to said seat member;

a forwardly projecting anchor member coupled to said seat and backrest members and adapted to overlie a tabletop; and a grip member coupled to said anchor member and having a pair of free ends disposed below said anchor member and adapted for gripping a bottom surface of the tabletop.

5. The baby seat as claimed in claim 4, wherein said backrest member is at the unfolded position when said stop member is at the locking position.

6. The baby seat as claimed in claim 4, wherein said position locking device further includes a biasing member for biasing said stop member to the locking position.

7. The baby seat as claimed in claim 6, wherein said position locking device further includes a button member mounted movably on one of said first and second positioning members and extending into one of said first and second receiving spaces to abut against said stop member, said but ton member being operable so as to force said stop member to the unlocking position against biasing action of said biasing member.

8. The baby seat as claimed in claim 6, wherein said position locking device further includes a pivot axle pivotally interconnecting said first and second positioning members.

9. The baby seat as claimed in claim 8, wherein said biasing member is a coiled compression spring sleeved on said pivot axle, said pivot axle extending slidably through said stop member.

10. The baby seat as claimed in claim 4, further comprising:

a connecting member coupling said grip member to said anchor member and said seat member such that said free ends of said grip member are supported for movement toward and away from said anchor member; and a latch member extending between said grip member and said backrest member for latching said free ends of said grip member in one of a plurality of positions when said backrest member is disposed at the unfolded position.

11. The baby seat as claimed in claim 10, wherein:

said anchor member includes a first U-shaped frame having a pair of parallel first portions connected pivotally and respectively to opposite lateral sides of said backrest member, and a first connecting portion interconnecting said first portions and disposed behind said backrest member;

said grip member including a second U-shaped frame having a pair of parallel second portions respectively disposed adjacent to said lateral sides of said backrest member, and a second connecting portion interconnecting said second portions and disposed behind said backrest member;

said connecting member including a pair of links, each of which has a first end connected pivotally to a respective one of said first portions, and a second end connected pivotally to said seat member;

each of said second portions being connected pivotally to a respective one of said links.

12. The baby seat as claimed in claim 11, wherein said latch member includes:

a rack attached to said backrest member; and a spring-loaded pawl attached to said grip member for movement with said grip member, said pawl being biased for meshing with said rack.

13. The baby seat as claimed in claim 11, wherein each of said first and second portions has a free end with a grip sleeve sleeved thereon.

14. The baby seat as claimed in claim 4, further comprising a tray removably disposed on said anchor member.

15. The baby seat as claimed in claim 4, wherein said first and second positioning members are integrally formed with said seat and backrest members, respectively.

* * * * *